United States Patent [19]

Martinez et al.

[11] Patent Number: 4,862,551

[45] Date of Patent: Sep. 5, 1989

[54] SELF-CONTAINED CLEANING SYSTEM

[76] Inventors: Donald L. Martinez, 919 Ponderosa La., Elizabeth, Colo. 80107; Solomon C. Martinez, 480 Cuchara St., Denver, Colo. 80221

[21] Appl. No.: 317,020

[22] Filed: Feb. 28, 1989

[51] Int. Cl.[4] ..... A47L 11/34

[52] U.S. Cl. ..... 15/321; 15/340.1

[58] Field of Search ..... 15/320, 321, 340.1

[56] References Cited

U.S. PATENT DOCUMENTS

| | | | |
|---|---|---|---|
| 4,109,340 | 8/1978 | Bates | 15/321 |
| 4,154,578 | 5/1979 | Bane | 15/320 X |
| 4,158,248 | 6/1979 | Palmer | 15/321 |
| 4,284,127 | 8/1981 | Collier et al. | 15/321 X |
| 4,336,627 | 6/1982 | Bascus | 15/321 |
| 4,443,909 | 4/1984 | Cameron | 15/320 |

OTHER PUBLICATIONS

Literature-Powermatic Cleaning Plant-1 Sheet.

Installation and Cleaning Specialist Magazine-Jul. 1988, Cover page and pp. 5, 6, 14, 15, 19, 25, 35, 37, 40, 41, 47, 49, 55.

Literature-Paloma-4 Page Brochure-May 1987.

Owner's Manual-Magnum Kohler Engine-Dated: 4/87.

*Primary Examiner*—Chris K. Moore

*Attorney, Agent, or Firm*—Norvell E. Von Behren

[57] ABSTRACT

A self-contained cleaning system using a truck mounted cleaning unit. The cleaning unit has a dual water tank system which is used to recirculate water through a propane hot water unit until the desired water temperature is obtained. The dual water tanks also permit the operator to bring his own supply of water to the job site. A dual pressure water unloading system allows quick switching from high to low water pressures while quick disconnects on the unloading system permit rapid removal for maintenance and/or replacement of the dual water pressure regulators used. The cleaning system is totally self-contained and may be operated without using the utilities of the customer.

18 Claims, 3 Drawing Sheets

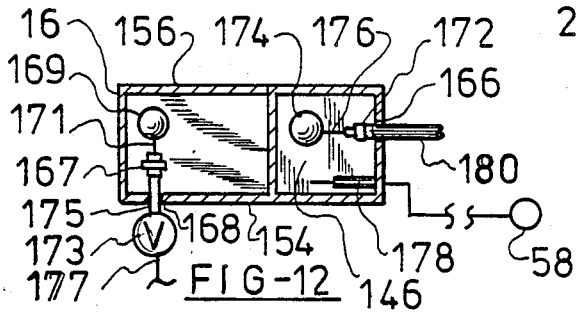
FIG-12
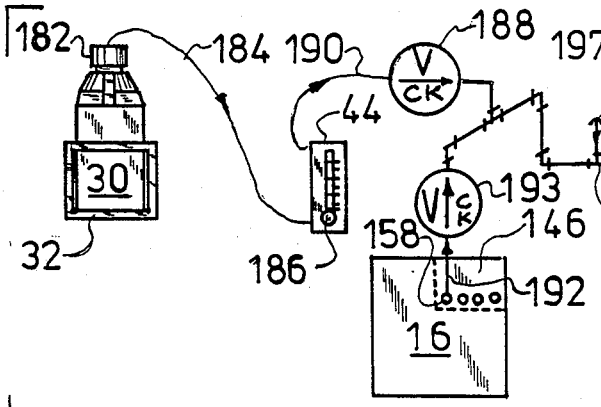
FIG-13
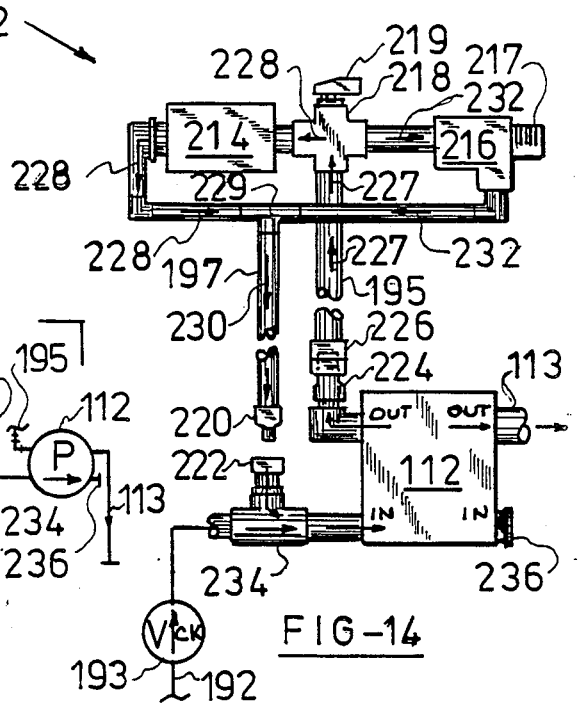
FIG-14
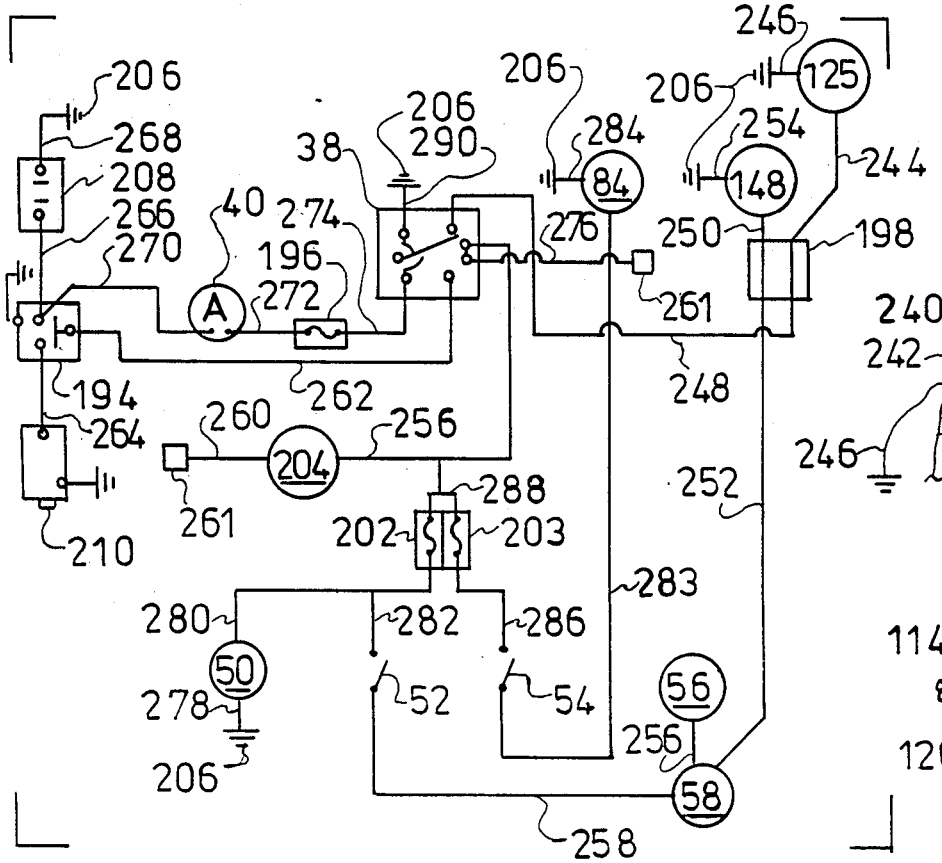
FIG-15
FIG-16
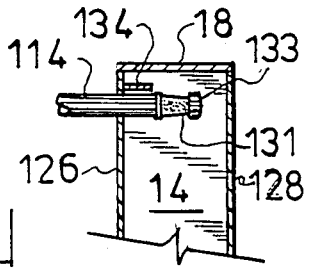
FIG-17

SELF-CONTAINED CLEANING SYSTEM

BACKGROUND OF THE INVENTION

This invention relates generally to cleaning systems and more particularly to a new and novel cleaning system and cleaning unit which is totally self-contained and truck mounted for use in cleaning rugs, carpets, upholstery or the like.

It is known in the prior art to use portable type cleaning units that can be taken into a customer's home to clean rugs, carpets, upholstery and the like. Such units generally are of the cannister type or self-contained extractors having low water capabilities ranging from 5–14 gallons.

It is also known to use truck mounted cleaning units which basically use larger and higher pressure equipment. This equipment is mounted in the cleaner's truck, parked outside of the customer's home. Long hoses then connect the cleaning unit to the cleaner's scrub wand which is the device used by the operator to do the actual cleaning. Various truck mounted cleaning units have been designed and sold over the years as a way for a person to easily get into business for himself, cleaning at a customer's home.

Known prior art units have been designed using water heaters which can raise water temperature to limited temperatures by one-pass systems that raise the cleaning water up to a given temperature determined by the temperature rise available from the unit's heater. It is desirable to have a cleaning unit which can raise water temperatures to higher temperatures in order to improve cleaning abilities. The prior art limited temperature heaters also have other drawbacks when they are kerosene operated heaters, similar to known types available. Because of the use of kerosene, dangerous and smelly conditions can occur in the operator's truck as well as requiring the carrying of separate loose containers of kerosene to refill the heater's fuel tank.

When cleaning rugs and carpets, a high water pressure is used while the cleaning of upholstery requires a lower water pressure. Many known prior art cleaning units have the ability to change cleaning water pressures, but require lengthy valve adjustments with a wrench at the operator's truck on the single pressure regulator used. It would be desirable to have a quick adjusting feature in the water system of the cleaning unit to easily switch from high to low pressures and vice versa in order to minimize changeover time. In addition to performing maintenance on the water pressure system regulating valve, a lengthy downtime with known prior art units was required in removing the various pipes and connections prior to the maintenance operation. It would be desirable to provide a means to be able to quickly and easily perform maintenance and/or regulator valve replacement.

Other problems have been encountered with prior art cleaning systems when the operator travels to a job site only to find that cleaning water to operate his unit is not available for various reasons such as frozen pipes at the home, breakdown of the home owner's water well pump and for other reasons. It would thereby be very desirable to have available a self-contained water supply which could be transported to the job site should these problems present themselves. In the extraction system for the waste taken out of the customer's rug, it would be very desirable to have available higher vacuum at the scrub wand in order to effect better waste water extraction. However, prior art waste tanks generally could collapse from higher vacuums. A way to prevent waste tank collapse would be desirable and would then provide a better overall cleaning unit which could operate at higher waste water extraction vacuums.

Many known prior art cleaning units can not be truly called self-contained since they also require an electrical connection to the customer's home in order to operate various electrical devices on the cleaning unit. Should the electrical power fail at the customer's home during cleaning, the operator must either wait for the electricity to come on or stop the cleaning and return later to finish the job. This problem can greatly reduce the operator's profits and a solution would be desirable.

The prior art units shown in the pages accompanying this application have some or all of the various drawbacks hereinbefore described as well as others and while most are advertised as self-contained truck mounted, they are not, for the reasons given. Accordingly their limitations should be apparent to the reader.

SUMMARY OF THE INVENTION

In order to overcome the problems inherent in the before described prior art truck mounted cleaning units and to provide a new and novel unit that overcomes these problems, there is provided by this invention a cleaning unit which we call the Magnum EX-1800 self-contained cleaning system. This novel system offers superior cleaning results and faster drying because of the novel features to be described. These features translate to better customer satisfaction, more referrals, increased profits and more repeat business.

The applicant's Magnum EX-1800 system is designed with many uses in mind such as carpet, rug and upholstery cleaning, and high pressure washing of vehicles, mobile homes, buildings, driveways, restaurant floors and kitchen hoods. The Magnum EX-1800 unit is a truly self-contained cleaner unit which has a dual tank capacity of 45 gallons of fresh water which can be filled automatically or manually to supply a hot water reserve. The unique recirculating fresh water system incorporated therein is thermostatically controlled and is designed to be able to heat water to 200° F. by recirculating the water between the heater and the recirculating tank which is contained inside of the reserve water tank. The novel recirculating water system thereby permits 200° F. water temperature to be obtained and constantly maintained throughout the cleaning operation. This is obtainable through the use of the novel recirculating system used with a propane operated 89,000 B.T.U. water heater. The propane heater is supplied by a propane tank mounted underneath the operator's truck thereby eliminating the operating hazards previously mentioned when using a kerosene water heater.

The hot water obtained from the propane heater is propelled to the job site by a high pressure pump capable of supplying 1500 psi delivery of up to 3.5 gallons per minute of hot water to the cleaner's scrub wand. The high-pressure pump is belt driven off of an 18 H.P. air-cooled gasoline driven engine which is supplied by the operator's truck fuel tank through a 12 volt fuel pump. This also eliminates fuel fume problems in the operator's truck and eliminates the dangers of refilling the gasoline engine at the job site by using a conventional can of gasoline and a funnel.

A dual pressure, manual valve operated unloader system is provided in the high-pressure water supply system, around the high-pressure supply pump, to permit quick and easy pressure changeover when switching from cleaning rugs to upholstery and back again. In addition, the unloader system and other parts of the complete water system are provided with quick disconnect fittings to make maintenance of the entire system quick and easy. This avoids costly downtime of the cleaning unit, for maintenance of the various parts, which results in greater operator profit.

To insure that the novel cleaning unit is truly self-contained, two of the three water pumps used, as well as the electrical system for the entire unit, operate off of a 12 volt starter battery used to start the 18 H.P. gasoline driven engine. The applicant's novel unit thereby is totally self-contained and weighs approximately 550 pounds when mounted on a frame which easily fits inside of a one-half ton truck.

A starter package is presently being sold with the applicant's novel cleaner unit and includes a 12 inch stainless steel high-pressure scrub wand with 125 feet of 2 inch TM vacuum hose and 150 feet of high-pressure water hose. A 25 feet, 1½ vacuum hose and four 2 inch hose connectors along with 50 feet of ½ inch rubber water hose are also included along with a two gallon chemical container, a stainless steel upholstery tool and a starter chemical package. When purchased with the basic frame mounted cleaning unit and mounted inside the operator's truck, the operator is ready to start his cleaning business with minimal cost. Other novel improved features are included in the applicant's Magnum EX-1800 unit and will be described more fully hereinafter when referring to the Description of the Preferred Embodiment.

Accordingly it is an object and advantage of the applicant's novel system to provide a totally self-contained cleaning unit which may be truck mounted and used at a job site totally independent from exterior water, electricity, waste connections and fuel sources.

Another object and advantage of the subject invention is to provide a self-contained cleaner unit which uses a novel dual water tank in combination with a propane water circulating heater to recirculate water up to a predetermined operating temperature with the fresh water system having a dual unloader system on the high-pressure pump for quick and easy selection between high and low operating pressures.

Still another object and advantage of the novel system described herein is to provide a cleaner unit which has quick disconnect connections on all of the water lines and water pumps in the system for quick removal of the various parts for maintenance and replacement where necessary.

Yet another object and advantage is to provide a new and novel high vacuum extraction system for the dirty waste water with a novel waste tank construction which functions to baffle waste water with the baffles serving to prevent inward collapse of the waste water tank when using high waste water extraction vacuums. The baffles also prevent the waste water in the tank from sloshing around while the truck is moving.

These and other objects and advantages will be shown and described more fully hereinafter when studying the drawings of the invention and from reading the Description of the Preferred Embodiment which has been given by way of illustration only.

BRIEF DESCRIPTION OF THE DRAWINGS

FIG. 12 is a cross-sectional view, taken along line 12—12 of FIG. 11.

FIG. 13 is a schematic view of the cleaning solution system used with the Magnum-1800 system.

FIG. 14 is a piping elevational view of the dual pressure regulator unloader system used with the high-pressure water in the invention.

FIG. 15 is an electrical schematic showing the control system for the applicant's novel invention.

FIG. 16 is an elevational view in schematic of the waste water kill switch used in the invention.

FIG. 17 is a cross-sectional view, taken along lines 17—17 of FIG. 9 showing the inlet pipe strainer in the waste water extraction system.

DESCRIPTION OF THE PREFERRED EMBODIMENT

Figure 1:
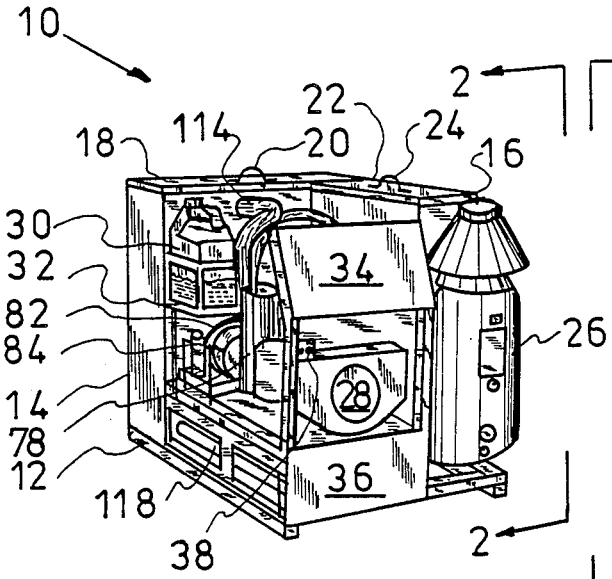
FIG. 1 is a perspective view of the applicant's Magnum EX-1800 truck mounted cleaning system.

Referring now generally to the drawings and in particular to FIG. 1 of the drawings there is shown generally by the numeral 10 the applicant's new and novel truck mounted cleaning system known as the Magnum EX-1800 unit. The cleaner unit is mounted on a frame 12 which may easily be carried in a one-half ton truck. A frame mounted waste tank 14 is positioned at the rear end of the unit while a fresh water tank 16 is also frame mounted on the right-hand side of the unit 10.

The waste tank 14 is used to contain extraction waste water and has a lid 18 positioned on the top thereof for access into the inside of the waste tank 14 to clean the inside thereof and for any maintenance needed on the interior parts thereof. A handle 20 is also mounted on the waste tank 18 for use in easily removing the lid from the top of the tank. In a similar manner the fresh water tank 16 contains a lid 22 and a handle 24 for access to the interior of the fresh water tank.

The waste tank 14 is an aluminum epoxy lined tank having a capacity of 78 gallons of dirty waste water which is extracted from the customer's rugs, carpets, upholstery and the like. The tank also contains an automatic shut-off feature to shut off the filling of the tank with waste water as will be described more fully when referring to FIG. 16.

The fresh water tank 16 is a dual water tank having a total capacity of 45 gallons of water which will be described more fully hereinafter when referring to FIGS. 10 and 11 of the drawings. A Paloma L.P.G. 89,000 B.T.U. demand hot water heater 26 is mounted on the frame 12 and is positioned in front of the dual fresh water tank 16 as can be seen in FIG. 1. The heater is manufactured by Paloma Industries, Inc. of Elk Grove Village, Illinois. The particular Model PH-12M contains a modulating burner with an automatic output control to supply up to 89,300 B.T.U./Hr. of hot water on demand with a wide temperature rise being available ranging from 60° F. to 100° F. with an incoming water temperature of 50° F. The propane to run the hot water heater 26 is supplied from an exterior mounted propane tank which may be mounted to the truck's frame on the driver's side. This provides safety in having the propane tank mounted outside of the truck's interior and also prevents smelly and dangerous fumes inside of the truck which occur when using prior art type kerosene hot water heaters.

Figure 6:
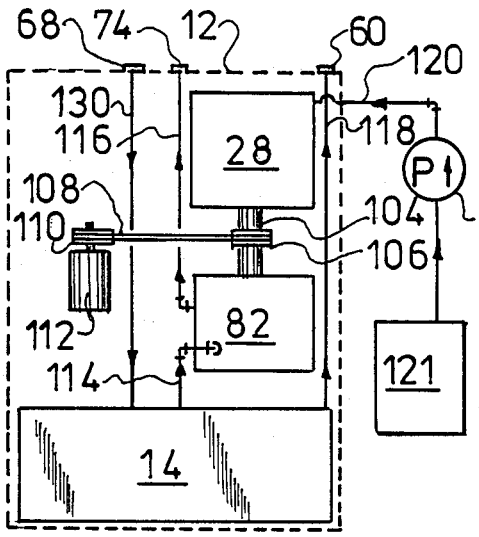
FIG. 6 is a diagrammatic plan view showing the extraction system of the applicant's invention.

Also mounted on the frame 12 is an 18 horsepower Kohler air-cooled gasoline engine 28 which has a full oil pressure system and a low oil pressure kill switch for added protection. The fuel for the gasoline engine 28 is supplied from the truck fuel tank 121 and through an electric fuel pump 76 by the fuel line 120 as can be seen in FIG. 6. By using the existing fuel tank 121 to fuel the gasoline engine 28, potential dangerous explosion problems are eliminated in refilling the gasoline engine 28 using a self-contained gasoline tank of the type used on prior art cleaning units. The function of the gasoline engine 28 will be described hereinafter when referring to FIG. 6 of the drawings.

Still referring to FIG. 1 of the drawings, the applicant's cleaning system uses a chemical container 30 which is mounted in a rack 32 which is fixedly attached to the frame 12. The chemical system is shown in FIG. 13 and will be described more fully later. The self-contained truck mounted unit 10 also contains an upper control panel 34 and a lower piping panel 36 which are spaced apart as shown in FIG. 1 above and below the gas engine 28. An engine key switch panel 38 is supplied with the gas engine as can be seen more clearly in FIG. 3 of the drawings.

The servicing and removal of the gas engine 28 is easily accomplished by removing the upper control panel 34 which allows the gas engine 36 to be removed for servicing. The panel 36 does not have to be removed, however.

Figure 2:
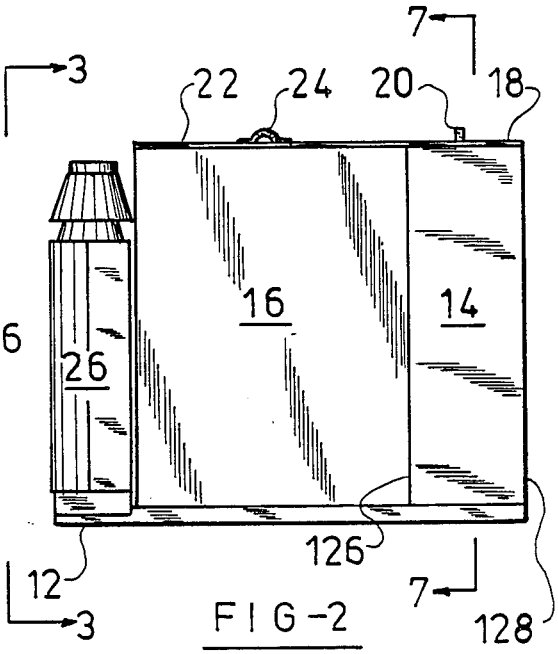
FIG. 2 is a right side elevational view, taken along line 2—2 of FIG. 1.
Figure 4:
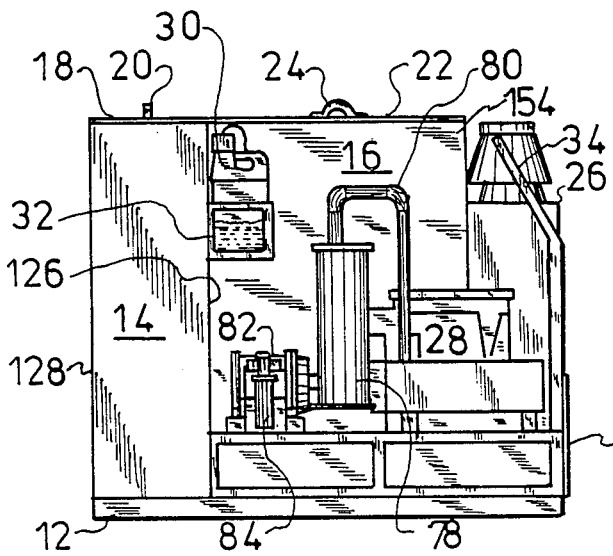
FIG. 4 is a left side elevational view, taken along line 4—4 of FIG. 3.

Referring now to FIGS. 2 and 4 of the drawings there are shown respectively a right side elevational view and a left side elevational view of the applicant's novel compact truck mounted cleaning unit 10. By referring also to FIG. 3 there can be seen in more detail the front of the unit which would usually be positioned inside the operator's truck so that the control panels 34 and the piping panels 36, as well as the key switch panel 38, are exposed at the side door of the operator's truck. This permits the operator to park his truck in the customer's driveway and to have quick and easy access to the unit through the opened side door of his truck.

Figure 3:
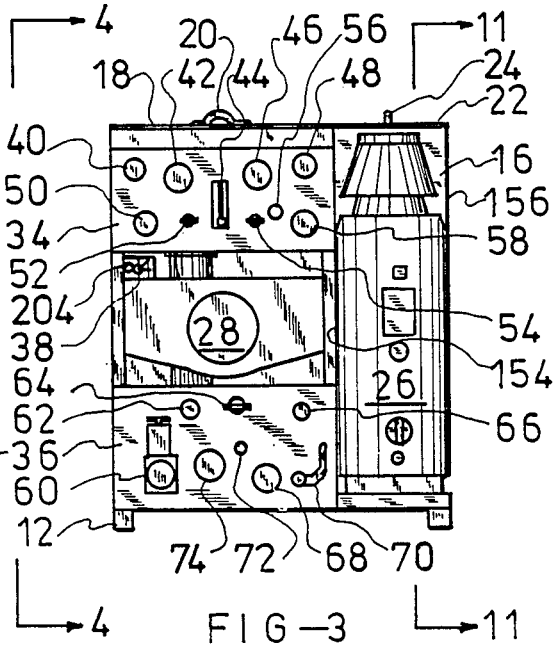
FIG. 3 is a front elevational view, taken along line 3—3 of FIG. 2 showing the upper operating gauge panel and the lower connection panel for the various pipes and hoses used by the operator.

FIG. 3 shows also in more detail the placement of the various controls on the control panel 34 which comprises an amperage gauge 40 for the gasoline engine 28 along with a vacuum gauge 42 for the blower used on the waste water extraction system of the applicant's invention. A flow meter/control valve 44 is available to meter and control the chemical used in the system and is positioned on the control panel next to the pressure gauge 46 for the high-pressure water pump which supplies fresh hot washing water to the operator's scrub wand as will be described hereinafter. The control panel 34 also contains an oil pressure gauge 48 for the gasoline engine 28 as well as an hour meter 50 to record total operating hours for the cleaning unit 10.

A pair of switches 52 and 54 are mounted on the control panel on each side of the flow meter 44 and are connected to turn on or off the recirculating pump and the reserve pump to be described hereinafter when referring to FIG. 10 of the drawings. The control panel also contains a light 56 which indicates that the hot water heater 26 is functioning as well as a thermostat 58 which controls the temperature of the water to be heated by the hot water heater.

The lower piping panel 36 contains the waste drain line valve 60 into which may be positioned a drain line to drain the waste water tank 14 into the street or an exterior container. The exhaust from the gasoline engine 28 is piped through a muffler 78 and the exhaust pipe 80 into the piping panel 36 at the outlet 62 and terminates there to exhaust the air-cooled gasoline engine 28 outside of the truck. The blower for the waste water extraction system also exhausts at 74 below the exhaust 62 for the gasoline engine and aids in blowing exhaust gas away from the truck's interior. A three-way valve 64 is positioned on the piping panel next to the water fill inlet 66 to the reserve tank. The vacuum connection 68, for the scrub wand used by the operator, is positioned between the reserve tank dump valve 70 and the pressure water outlet 72 to the scrub wand. The operation of these outlets, valves, etc. will be described more fully later when discussing the waste water extraction system shown in FIG. 6 and the fresh water supply system shown in FIG. 10.

Figure 5:
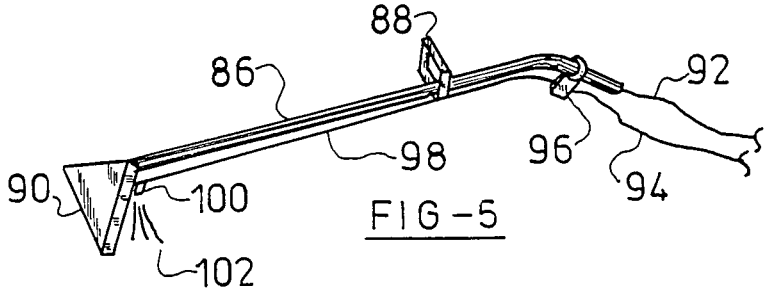
FIG. 5 is a perspective view of the operator's scrub wand which he uses to apply high-pressure water and cleaning solution and to extract the dirty waste water and solution by a high vacuum hose back to the Magnum-1800 cleaning unit.

Referring now to FIG. 5 of the drawings there is shown a typical scrub wand 86 having a handle 88 connected to a suction head 90 by a vacuum line 92 which would be connected through a long length of vacuum hose into the vacuum connection 68 on the piping panel 36 at the cleaner unit 10. A high-pressure water line 94 is also connected by a long high-pressure water line into the pressure water connection 72 on the piping panel 36. At the scrub wand 86, the high-pressure water line 94 is controlled by a hand operated valve which modulates the flow of hot high-pressure water and chemicals through a water line 98 and into a spray head 100 mounted as shown to spray water 102 into the rug, carpet, upholstery or the like. When using the cleaner on upholstery a small scrub wand is used as is known in prior art systems.

Turning now to FIG. 6 of the drawings there will be described in detail the extraction system of the applicant's invention and how the gasoline engine operates to drive the extraction system as well as the high-pressure fresh water pump 112. As before described, the gasoline engine 28 is mounted to the frame 12 which is shown in dashed lines in FIG. 6. A takeoff drive shaft 104 has a pulley 106 attached thereto which is used to drive the high-pressure fresh water pump 112 by means of the belt 108 and pump pulley 110. Also connected to the drive shaft is the blower 82 used in the extraction system. The blower 82 is mounted to the frame 12 as is the high-pressure fresh water pump 112.

As has been previously mentioned, the fuel to supply the gasoline engine 28 comes from the truck fuel tank 121 and through a 12 volt fuel pump 76 and the fuel line 120. The fuel pump 76 also operates off of the 12 volt battery 208 which is used to start the gasoline engine 28. The battery 208 is not shown in FIG. 6 for purposes of clarity, but is shown in FIG. 15 which will be described in detail later.

Still referring to FIG. 6 of the drawings, it can be seen that exhaust connection 74 on the piping panel 36 connects to the exhaust connection of the blower 82 through the exhaust line 116. The blower 82 is a Roots 36 Ral Displacement Blower which provides excellent drying results on the customer's rugs, carpets, upholstery or the like. This unit is capable of extracting waste through the scrub wand 86 up to 300 feet away from the customer's house, since it can draw a vacuum of approximately 18 inches of mercury. The intake to the blower is connected to the waste water tank 14 by the intake line 114 and a large vacuum is created inside the waste water tank 14 sufficiently to draw waste water from the scrub wand vacuum line 92 through the vacuum connection 68 on the piping panel 36 and through the vacuum intake line 130. In order to drain the waste water tank 14, the drain valve 60 is opened and waste water will flow out line 118 by gravity after the gasoline engine 28 and blower 82 are shut off. The arrows in FIG. 6 show the flow direction of the extraction system through the lines 130, 114 and 116 as well as the direction of the draining of the waste tank 14 through the line 118.

Figure 7:
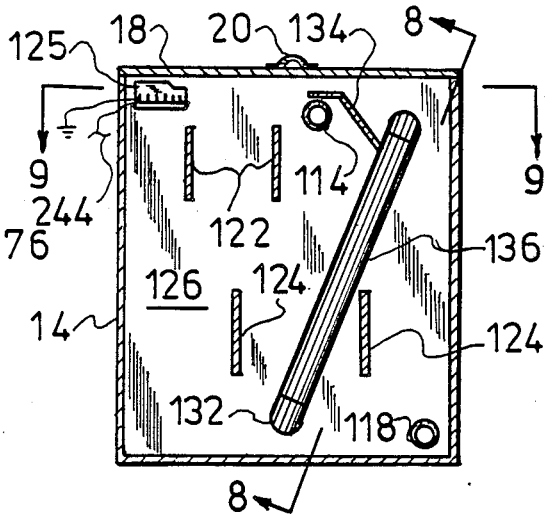
FIG. 7 is a cross-sectional view, taken along line 7—7 of FIG. 2 showing the inside of the novel waste water tank used in the extraction system.
Figure 9:
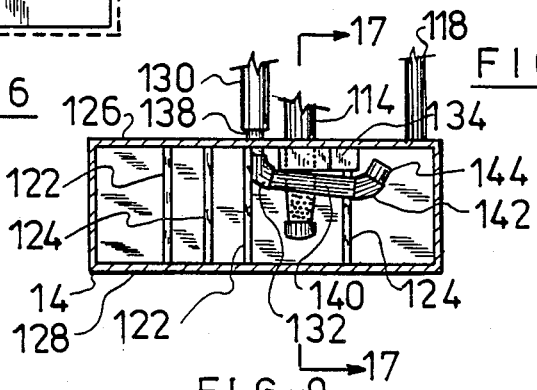
FIG. 9 is a cross-sectional view, taken along line 9—9 of FIG. 7 showing in detail the novel baffles in the waste water tank.
Figure 8:
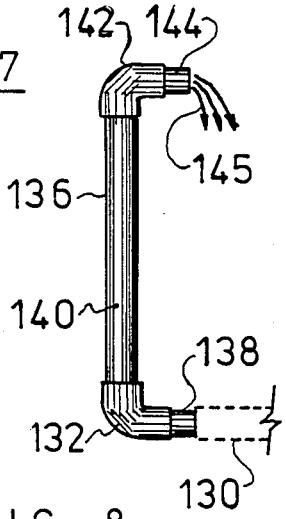
FIG. 8 is a plan view, taken along line 8—8 of FIG. 7.

Referring now to FIGS. 7–9 there will be shown in detail the inner construction of the novel waste water tank 14. As previously mentioned, since the Roots blower 82 is powerful enough to draw an 18 inch mercury vacuum in the waste water tank 14, a novel construction of the inner portion of the tank prevents an inward collapse of the aluminum tank. A plurality of baffles 122 and 124 are used to baffle waste water to prevent it from sloshing around if the operator chooses to carry the waste water away from the job site prior to dumping it. The upper baffles 122 are spaced apart as shown in FIG. 7 and are spaced above the lower baffles 124 and span the width of the waste water tank 14. They are fixedly attached, by welding, to the front wall 126 and the rear wall 128 of the waste water tank 14. When positioned thusly, the baffles 122 and 124 function to support the front wall 126 and the rear wall 128 from movement as well as functioning as water baffles.

A kill switch 125 may also be mounted in the upper portion of the waste water tank and will function as will be described later when referring to FIG. 16 of the drawings. The blower intake line 114 terminates at the upper portion of the waste water tank 14 and is connected to a pipe strainer 131, as can be seen more clearly in FIG. 17, which prevents rug and carpet fibers from being drawn into the blower intake line 114. The vacuum intake line 130 from the scrub wand terminates inside the waste water tank 14 at the intake stub 138 which is connected to the elbow 132 shown more clearly in FIGS. 8 and 9. An elongated piece of plastic pipe 140 extends the waste water inlet to the same elevation as the blower intake connection 114 through the elbow 142 and the stub 144.

The elongated piece of plastic pipe 140 is also positioned around a vacuum baffle plate 134 which is fixedly attached by welding to the side wall 126 of the waste water tank 14. This pipe assembly 136 and baffle 134 then permit the waste water to be drawn into the waste water tank 14 through this assembly and to drop out of the pipe stub 144 into a tank as shown by the arrows 145 in FIG. 8. The vacuum baffle plate 134 separates the inlet and exhaust lines in the tank to permit the proper vacuum to be maintained in the tank by the blower 82.

Figure 10:
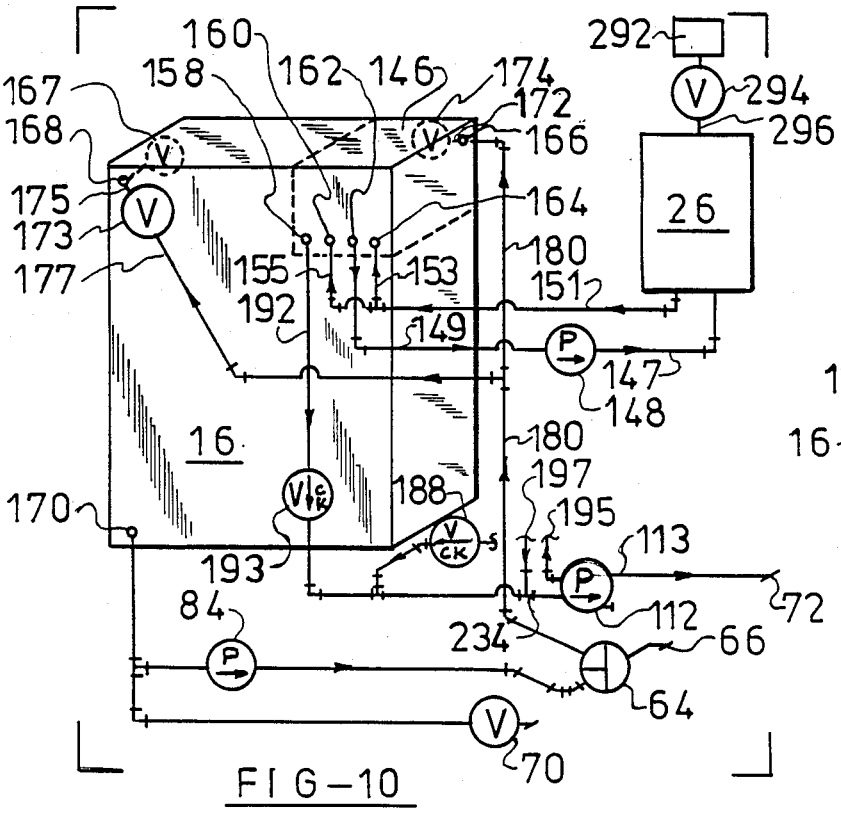
FIG. 10 is a schematic view of the fresh water system used in the applicant's cleaner unit.
Figure 11:
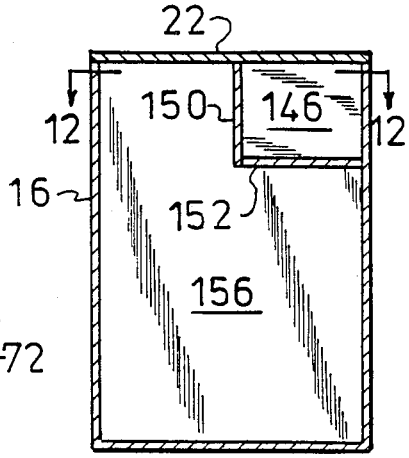
FIG. 11 is a cross-sectional view, taken along line 11—11 of FIG. 3 showing the dual fresh water tank system used in the high-pressure fresh water portion of the invention.

Referring now to FIGS. 10–12 there will be described the novel fresh water supply system for the applicant's cleaning unit 10. As before described the fresh water supply tank 16 is constructed as a dual tank having an inner tank 146, shown in dashed lines in FIG. 10. The inner tank 146 functions as a recirculating tank and has a capacity of 3 gallons while the water supply tank 16 has a capacity of 42 gallons, making a total of 45 gallons of supply water available for the operator's use. The 42 gallon water supply tank 16 then functions as a reserve water tank which can be used to bring water to the cleaning site if none is available or if circumstances prevent using the customer's water.

Water from the reserve tank 16 is able to be fed into the inner 3 gallon circulating tank 146 by means of the pipe 170 and the 12 volt reserve tank pump 84, into the three-way valve 64 on the piping panel 36. The three-way valve 64 may then be positioned to allow pumped water to pass through the valve into the pipe 180 and into the recirculating tank through the shut-off valve 172 which is float operated by means of a water float 174 attached to a float rod 176. The pipe 180 enters into the recirculating water tank 146 through the opening 166 in the tank as shown more clearly in FIG. 12.

Both of the fresh water tanks 16 and 146 may be filled through the water fill inlet 66 on the piping panel 36 and through the three-way valve 64 which may be turned to permit outside water from a hose bibb to pass initially into the water system through the three-way valve 64 and into the pipe 180 and the pipe 177. A ball valve 173 is also positioned in the pipe 177 on the outside of the fresh water tank 16 and the tank also contains an inner float operated shut-off valve 167. The valve 167 is float operated to shut off upon a filled condition by means of the float 169 attached to the float rod 171. Accordingly water can enter into the fresh water reserve tank 16 through the ball valve 173 and the pipe 175 which is positioned in the opening 168 in the tank side 154.

The recirculating water tank 146 is shown in FIG. 11 constructed inside the reserve water tank 16 by a pair of plates 150 and 152 which are welded to each other and to the front wall 154 and the rear wall 156 of the tank. The plates 150 and 152 then form the side wall and bottom wall of the recirculating water tank. Four openings 158, 160, 162 and 164 are formed in the recirculating water tank 146 as shown in the FIG. 10 view. The opening 158 is used to connect the recirculating water tank 146 to the pipe 192 which runs to the high-pressure pump 112 through a check valve 193. The high-pressure pump 112 is manufactured by Hypro Company and is capable of delivering 1500 psi of fresh water pressure with a capacity of up to 3.5 gallons per minute to handle the high-pressure water needs of the operator. This is accomplished through the applicant's novel dual unloader system which will be described hereinafter when referring to FIG. 14 of the drawings.

There will now be described how the unique dual water tank system is used to supply heated water at temperatures of up to 200° F. at the scrub wand 86. Since known prior art heaters supply hot water through one-pass hot water systems, the prior art heaters are only as good as the ability of the heater to raise water temperature in one pass through their system. In the applicant's novel recirculating system, the fresh water is continually recirculated through the hot water heater 26 until the temperature is raised as high as 200° F. Since hot water gives a better cleaning on the customer's property, the applicant's novel recirculating system will permit a wide range of hot water temperatures by reason of the recirculating system coupled with the control panel mounted thermostat 58.

In FIG. 10 there can be seen how the recirculation of the water is obtained. A 12 volt recirculating pump 148 is connected through the pipe 149 to the opening 162 in the recirculating tank 146 and to the heater 26 through the pipe 147. This allows fresh water to pass through the heater 26 back into the recirculating tank 146 through the pipes 151, 153 and 155. The pipes 153 and 155 are connected to the openings 164 and 160 respectively in the wall of the recirculating tank 146. As a result, the recirculating pump 148 will continually recirculate the fresh water through the hot water heater and back into the recirculating tank 146 until the temperature called for by the control mounted thermostat 58 is reached.

It can be seen how the temperature in the recirculating tank 146 is monitored in FIG. 12 which shows a thermocouple sensor 178 mounted inside the tank and connected to the thermostat 58 of the hot water heater to monitor the water temperature.

Referring now to FIG. 13 of the drawings there will be described the cleaning solution system used in the applicant's novel cleaner unit 10 which comprises a cleaning solution container 30 positioned in a rack 32, which is fixedly attached to the frame 12. A screw-on cap 182 contains a hole, not shown in the drawings, into which is placed an elongated length of refrigerator hose 184 which connects to the float meter/control 44 mounted on the control panel 34. A knob 186 is used to control the flow of soap and other chemicals used in the cleaning process. The flow meter/control 44 is also connected by the refrigerator hose 190 to a check valve 188 and to the pipe 192 connected to the opening 158 in the recirculating water tank 146. As the high-pressure water pump 112 pumps water from the recirculating water tank 146 through the water pipe 192, soap and other chemicals contained in the chemical container 30 are drawn through the hose 190 and the check valve 188 into the high-pressure fresh water system and to the scrub wand 86. The check valve 193 prevents spill back of high water pressure while the unloader system of the high-pressure pump 112 is operating and also prevents spill back of soap solution and chemicals into the recirculating tank 146. The check valve 188 prevents spill back of high-pressure water into the flow meter/control 44 and into the chemical container 30.

Referring now to FIG. 14 of the drawings there will be shown in detail the novel dual pressure unloading system for the applicant's high-pressure water pump 112. Known prior art unloader systems use a single pressure regulator in the unloading system to obtain the desired water pressure and to relieve the pressure on the high-pressure demand pump 112 when the scrub wand valve 96 is released. This assures that the high-pressure pump 112 will not be damaged since it is directly connected by the belt drive to the gasoline engine 28. When cleaning a customer's home it is usual to use a low-pressure water supply to clean the upholstery while using a high-pressure water supply on the carpets and rugs. For example, upholstery and other delicate fabrics may need water pressures in the range of 40–100 psi while rugs and carpets may require water pressures in the range of 400–500 psi for best cleaning.

Since known prior art cleaning systems use single unloader regulating valves, the operator must go back to his truck and adjust the pressure regulator slowly with a wrench to the desired pressure and repeat the operation every time he changes pressures. With the applicant's novel improved unloading system, at least two unloader pressure regulators are used as shown in FIG. 14. The novel unloader system is shown generally by the numeral 212 and comprises a high-pressure regulator 214 for use on rugs and carpets and a low-pressure regulator 216 for use on upholstery. The high-pressure regulator 214 may be one manufactured by Para Plate Company which could be set for pressures between 100 and 1000 psi while the low-pressure regulator 216 may be one manufactured by Watts Company and which contains an external gauge 217.

The dual regulating valves 214 and 216 are positioned on opposite sides of a three-way valve 218 and connected thereto as shown in FIG. 14. A valve handle 219 on the three-way valve 218 may then be quickly used by the operator when switching from one pressure to another pressure after the valves have been preset to desired pressures. In order to further make the applicant's invention more desirable, the dual pressure unloader system 212 may be connected to pipe 195 as shown with female quick disconnect fittings 226 and to pipe 197 as shown with male quick disconnect fittings 220 for mating with similar male quick disconnect fittings 224 and female quick disconnect fittings 222 used on the water system. When connected thusly the entire unloader system 212 can be quickly removed from the cleaning unit 10 to service the pressure regulating valves 214 and 216 as well as the three-way valve 218.

In FIG. 14, the various arrows 227, 228 and 230 represent the flow of high-pressure water when the water system unloads while the arrows 227, 232 and 230 represent the flow of low-pressure water when the three-way valve 218 has been turned at the handle 219 to divert low-pressure water through the system. The tee connection 229 connects the two pressure loops while the tee connection 234 feeds the adjusted water pressure back into one of the inlets of the high-pressure pump 112. The other inlet to the high-pressure pump 112 has been capped by the plug 236 while the outlet 113 feeds the predetermined fresh water supply to the scrub wand valve 96 through the pipe panel connection 72 and through the high-pressure water line 94.

While in FIG. 14, the novel unloader system 212 has been shown with quick disconnects, the applicant's entire fresh water system and all the fresh water pumps have been connected with various quick disconnects which make servicing of the entire fresh water system extremely quick and easy, adding greatly to the serviceability of the entire cleaning unit.

Turning now to FIGS. 15 and 16 there will be described the electrical control circuit for the cleaning unit and the automatic kill switch 125 mounted in the waste water tank 14. As before mentioned the waste water tank 14 contains a kill switch 125 which is shown in FIG. 16 as well as in FIG. 7 of the drawings. The kill switch 125 is manufactured by the Jabco Division of ITT Company and has an inner float 238 designed to float on the waste water 239. The float 238 is held in place by the float shaft 240 and reacts to waste water 239 which enters the kill switch through a plurality of slots 241 in the bottom of the switch case. The actual electrical kill switch 242 is positioned as shown in FIG. 16 and acts to shut off electrical power through the electrical line 244. An electrical ground 246 completes the kill switch circuit. The electrical wire 244 feeds into the junction block 198 and back to the key switch panel 38 on the gasoline engine through the electrical line 248. A raising of the waste water 239 in the waste water tank 14 above the switch float setting will then automatically shut off the gasoline engine 28 as well as the direct connected high-pressure fresh water pump 112. This assures that an accidental over filling of the waste water tank will not occur due to operator's failure to properly empty the tank.

The electrical line 250 for the recirculating pump 148 also runs to the junction box 198 and ultimately to the thermostat 58 through the electrical line 252 and the ground connection to 206 is completed through the electrical line 254. The light 56 on the control panel is also connected, through the electrical line 256, to the thermostat 58 to indicate that the propane heater 26 is properly operating. The recirculating pump switch 52 connects to the thermostat 58 through the electrical line 258 to turn off and on the recirculating pump 148. Power for this is supplied through the 10 ampere fuse 202 which is ultimately connected to the battery 208 through the key switch 38 on the gasoline engine.

The oil pressure light 204 is also connected to the power line 256 and back to the same battery. The electrical line 260 then is connected to the rectifier regulator 261 on the gasoline engine 28 to complete the circuit.

The solenoid 194 of the gasoline engine 28 is also connected through electrical line 262 back to the engine key switch 38 while the engine starter 210 is connected to the engine solenoid 194 through the electrical line 264. The gasoline engine battery 208 is connected by the electrical line 266 to the gasoline engine solenoid 194 and also to ground, through the electrical line 268 to complete the electrical circuit.

The ampere gauge 40 is connected, through the electrical line 270 to the gasoline engine solenoid 194 and to a 30 amp fuse 196 through the electrical line 272. The other side of the fuse 196 runs to the engine key switch 38 through the electrical line 274. The key switch 38 also is connected to the rectifier regulator 261 of the gasoline engine through the electrical line 276 as shown in the drawing FIG. 15.

The gasoline engine hour meter 50 is connected to ground 206 through the electrical line 278 and to the 10 amp fuse 202 through the electrical line 280. The recirculating pump switch 52 is also connected, through electrical line 282, to the same fuse. The operation of the reserve tank pump 84 is controlled by the reserve tank pump switch 54 through the electrical line 283. The reserve tank pump 84 is also connected to the ground 206 through the electrical line 284. A 10 amp fuse 203 is also connected to the reserve tank pump 54 through the electrical line 286. The fuse 203 is connected to 10 amp fuse 202 through electrical line 288. The ground connection 206 for the engine key switch 38 is through the electrical line 290 which completes the electrical circuitry for the applicant's novel control circuit.

Referring now to FIG. 17 there will be described how the strainer filter 131 is connected to the inlet pipe 114 of the waste water extraction system. A pipe cap 133 is fixedly attached to the strainer filter to prevent water from entering into the top of the strainer which is constructed with a plurality of holes to filter or strain out carpet and upholstery lint from entering the extraction system. It can be seen in FIG. 17 how the strainer/-filter 131 is positioned below the vacuum baffle plate 134.

From the foregoing, it can be seen how the applicant's novel cleaning system is able to be constructed to operate to accomplish all the objects and advantages hereinbefore described. It should be apparent that various changes and modifications may be made to the system and these are considered to be within the spirit and scope of the applicant's invention.

For example in FIG. 10, while it is preferable to mount the propane tank 292 with its attached shut-off valve 294 under the floor of the truck thereby keeping the propane supply line 296 to the propane heater 26 short, it would also be possible to mount the tank 292 and valve 294 outside of the operator's truck in a convenient position. The preferred embodiment given in the foregoing specification has only been given by way of illustration only and the applicants are not to be limited to the exact embodiment shown and described.

Having now completely described our invention, we claim:

1. In a truck mounted cleaning unit for positioning inside of a truck having a fuel tank, the cleaning unit being used with a high pressure scrub wand and a high pressure water hose and a vacuum hose to spray high pressure water and cleaning solution on rugs, carpets, upholstery and the like to extract the sprayed water, cleaning solution and dirt from the rugs, carpets, upholstery and the like, the improvement comprising:

(a) the cleaning unit having a water system with water lines and comprising in part a dual water tank, the dual water tank comprising a reserve water tank for storing water and a recirculating water tank for recirculating water, the reserve water tank being capable of being pumped to the recirculating water tank as needed through a reserve pump;

(b) the cleaning unit having a recirculating hot water heater connected to the recirculating water tank and being capable of recirculating water, through the recirculating water tank and through the hot water heater, until a predetermined temperature is obtained; and (c) the cleaning unit having a dual pressure unloading system for quickly switching from a low pressure to a high pressure as desired through a high pressure pump.

2. The improvement as defined in claim 1 wherein at least a portion of the water lines in the water system are installed with quick disconnect fittings for quick and simplified removal for maintenance purposes.

3. The improvement as defined in claim 1 wherein the cleaning unit contains an internal combustion engine for use in the cleaning unit, with the internal combustion engine being connected to the truck fuel tank through an electric fuel pump thereby providing a safety feature which eliminates explosion problems that may be encountered with filling fuel in the internal combustion engine.

4. A self-contained truck mounted cleaning unit for positioning inside of a truck having a fuel tank, the cleaning unit being used with a high-pressure scrub wand and a high-pressure water and cleaning solution on rugs, carpets, upholstery and the like at a customer's job site, the scrub wand also being used with a vacuum hose to extract the cleaning water, cleaning solution and dirt from the rugs, carpets, upholstery and the like, comprising:

(a) a frame;

(b) an internal combustion engine, having a 12 volt battery and being fixedly attached to the frame and containing means to supply fuel to the internal combustion engine;

(c) an extraction system, associated with the frame and the internal combustion engine, for extracting dirty water and cleaning solution through the scrub wand and comprising;

(1) a blower, having an intake and an exhaust, the blower being fixedly attached to the frame and being driven by the internal combustion engine;

(2) a waste water tank, having an upper portion, and a lower portion, fixedly attached to the frame and connected to the blower intake at the upper portion thereof, the waste tank also being connected at the lower portion thereof to the vacuum hose and the scrub wand,

[a] internal means, contained within the waste tank to baffle the tank to minimize liquid movement in the tank and to strengthen the waste tank from internal collapse due to a high vacuum in the interior of the tank, (d) a circulating water system, associated with the frame, for circulating high-pressure heated water and cleaning fluid to the customer's job site through the high-pressure water hose and the scrub wand, the circulating water system comprising;

(1) at least two water tanks, associated with the cleaning unit and connected thereto and to each other by a plurality of pressure water lines, one of the water tanks being a reserve water tank for containing a predetermined reserve of water that may be previously filled in the reserve tank and transported to the customer's job site and the other of the tanks being a recirculating water tank for containing heated water used in the operation of the cleaning unit;

(2) a hot water heater, associated with the cleaning unit and connected thereto by a plurality of pressure water lines, the heater being used to heat water from the recirculating tank to a predetermined water temperature by recirculating the water continuously between the recirculating tank and the heater until the water is heated to the desired water temperature, (3) a plurality of water pumps, associated with the cleaning unit and connected thereto by a plurality of pressure water lines, the water pumps comprising,

[a] a reserve pump to draw water from the reserve tank as desired to fill the recirculating tank;

[b] a recirculating pump to recirculate hot water from the recirculating tank to the hot water heater and back continuously until the hot water is at a desired predetermined temperature,

[c] a high-pressure pump to draw heated water from the recirculating tank and to pump the heated water through the high-pressure water hose and the scrub wand to accomplish the cleaning at the customer's job site;

(4) control means, associated with the cleaning unit and the circulating water system, for controlling the cleaning water temperature and water pressure at predetermined temperatures and pressures;

(e) a cleaning solution system comprising;

(1) a cleaning solution tank, associated with the cleaning unit, for containing liquid soap solution, color brighteners, deodorizers and the like;

(2) a flow meter and control valve, associated with the cleaning solution tank for metering and controlling the flow of cleaning solution to the high pressure pump; and (3) means, associated with the cleaning solution, for connecting the solution tank and the flow meter and control valve to each other and to the high pressure pump, the connecting means also comprising backflow preventing means to prevent backflow of water from the high pressure pump into the recirculating system.

5. The cleaning unit as defined in claim 4 wherein the means to supply fuel to the internal combustion engine comprises a fuel line connected to the fuel tank of the truck.

6. The cleaning unit as defined in claim 4 wherein the internal means, in the waste tank, to baffle comprises a plurality of plate baffles positioned between opposite sides of the tank, the baffles functioning also to strengthen the opposite sides from collapsing inwardly due to a high vacuum in the interior of the tank upon starting the blower used in the extraction system.

7. The cleaning unit as defined in claim 4 wherein the recirculating water tank is constructed and positioned inside the reserve tank.

8. The cleaning unit as defined in claim 4 wherein the hot water heater is a propane operated heater which eliminates kerosene smell in the truck and explosion problems using kerosene prior art hot water heaters.

9. The cleaning unit as defined in claim 4 wherein the reserve pump and the recirculating pump are 12 volt motor driven pumps which operate from the battery on the internal combustion engine.

10. The cleaning unit as defined in claim 4 wherein the high-pressure pump is belt driven off of the internal combustion engine and the blower is direct driven off of the internal combustion engine.

11. The cleaning unit as defined in claim 4 wherein the control means includes in part a dual pressure unloading system for quickly switching from a low-pressure to a high-pressure as desired.

12. The cleaning unit as defined in claim 11 wherein the dual pressure unloading system is constructed with quick disconnect connections for quick and simplified removal of the unloading system for maintenance purposes.

13. The cleaning unit as defined in claim 4 wherein at least a portion of the water connections in the circulating water system are quick disconnect connections for quick and simplified removal for maintenance purposes.

14. In a truck mounted cleaning unit for positioning inside of a truck, the cleaning unit being used with a high-pressure scrub wand and a high-pressure water hose from a high-pressure pump to spray high-pressure water and cleaning solution on rugs, carpets, upholstery and the like, the improvement comprising the high-pressure pump having a pressure unloader system attached thereto, the unloader system comprising at least two pressure regulating valves positioned on opposite sides of a three-way valve, one of the pressure regulating valves being a high-pressure regulator for directing high-pressure water from the high-pressure pump to the cleaning system for use in cleaning the carpets and rugs, the other of the pressure regulating valves being a low-pressure regulator for directing low-pressure water from the high-pressure pump to the cleaning system for use in cleaning the upholstery, the three-way valve being used by the operator of the cleaning unit to quickly change from low pressure to high pressure as desired and vice versa.

15. The improvement as defined in claim 14 wherein the pressure unloader system is constructed with quick disconnect fittings so the pressure unloader system can be quickly and easily removed to service or replace the pressure regulating valves and/or the three-way valve.

16. The improvement as defined in claim 14 wherein the high-pressure regulator is capable of being set between a range of 100–1000 psi of pressure and the low-pressure regulator is capable of being set between a range of 50–175 psi of pressure.

17. The improvement as defined in claim 1 wherein the hot water heater is operated from propane supplied under pressure from a propane tank mounted on the frame of the truck.

18. The cleaning unit as defined in claim 4 wherein the hot water heater is operated from propane supplied under pressure from a propane tank mounted on the frame of the truck.

* * * * *